US007887374B1

(12) United States Patent
Lee et al.

(10) Patent No.: US 7,887,374 B1
(45) Date of Patent: Feb. 15, 2011

(54) ELECTRICAL CONNECTOR

(75) Inventors: Kuo-Chi Lee, Taipei County (TW); Chin-Huang Lin, Taipei County (TW)

(73) Assignee: Concraft Holding Co., Ltd., Grand Gayman (KY)

( * ) Notice: Subject to any disclaimer, the term of this patent is extended or adjusted under 35 U.S.C. 154(b) by 0 days.

(21) Appl. No.: 12/820,515

(22) Filed: Jun. 22, 2010

(30) Foreign Application Priority Data

May 14, 2010 (TW) ..... 99209027 U

(51) Int. Cl.
*H01R 24/00* (2006.01)

(52) U.S. Cl. ..... 439/660
(58) Field of Classification Search ..... 439/660
See application file for complete search history.

*Primary Examiner*—Briggitte R Hammond
(74) *Attorney, Agent, or Firm*—Rosenberg, Klein & Lee

(57) ABSTRACT

An electrical connector includes a terminal fastening element and a plurality of terminals. Each of the terminals has a bending section covering the top side, the front end and the bottom side of a tongue portion of the terminal fastening element and is spaced apart from the bottom side of the tongue portion at h an elastic space. Therefore, even if the deviation of the mating terminal is greater, the electrical connection between the terminal and the mating terminal is still fine.

9 Claims, 8 Drawing Sheets

ELECTRICAL CONNECTOR

This application claims the benefit of Taiwan Patent Application Serial No. 099209027, filed May 14, 2010, the subject matter of which is incorporated herein by reference.

BACKGROUND OF THE INVENTION

1. Field of the Invention

The present invention relates to an electrical connector, more particularly to an electrical connector including a terminal covering a tongue portion and distancing an elastic space to the tongue portion.

2. Description of the Prior Art

For transmitting large quantity of information between a display and a CPU of a notebook compute, for example, an electrical connector with Low Voltage Differential Signal standard is used as the signal transmitting interface FIG. 1 is a partially exploded view of an electrical connector with Low Voltage Differential Signal standard of the prior art. The prior electrical connector 1 includes an insulation body 10 and a plurality of terminals 20. The insulation body 10 includes a tongue portion 11 and a terminal fastening portion 13. The top side of the tongue portion 11 has a plurality of terminal grooves 12. The terminals 20 are in the form of a sheet structure. The front end of the terminal 20 is fastened to the bottom of the terminal groove 12, and the back end of the terminal 20 passes through terminal fastening portion 13 to contact a signal transmission wire.

Since the terminals 20 are exposed partially from the top side of the tongue portion 11. Therefore, when the electrical connector 1 is inserted to a mating electrical connector, the front end of the terminal 20 may be tilted upward due to improper inserting operation. Moreover, the terminal 20 is attached on the insulation body 10. If the mating terminal groove in the mating electrical connector is too large to influence the position of the mating terminal, the electrical connection between the terminal 20 and the mating terminal may lead to improper connection, thereby causing poor transmission quality of the signal.

SUMMARY OF THE INVENTION

Therefore, in order to solve the above-mentioned drawbacks, it is the object of the present invention is to provide an electrical connector including a terminal having a bending section and a tongue portion. The bending section covers the top side, the front end and the bottom side of the tongue portion and distances the bottom side of the tongue portion with an elastic space.

An electrical connector is provided according to the present invention to be inserted to a mating electrical connector, which includes a plurality of mating terminals. The electrical connector of the present invention accordingly includes an insulation body, a terminal fastening element, and a plurality of terminals. The insulation body has a terminal retaining recess. The terminal fastening element is assembled to the insulation body. The terminal fastening element includes a terminal fastening portion and a tongue portion. The tongue portion extends from the terminal fastening portion, and has a top side, a bottom side and a front end.

The terminals are arranged along an arranging direction. Each of the terminals defines a connecting end, a bending section and a retaining end in sequence. The connecting end is fixed on the terminal fastening portion. The bending section covers to the top side, the front end and the bottom side of the tongue portion and is spaced apart from the bottom side of the tongue portion with an elastic space. The retaining end is received and applies an elastic force onto the terminal retaining recess. When the electrical connector is inserted into the mating electrical connector, the mating terminal pushes the terminal to decrease the elastic space.

In conclusion, the terminal of the present invention has a bending section covering the top side, the front end and the bottom side of the tongue portion. Therefore, the terminal will not be tilted to disengage from the terminal groove as encountered during use of the prior art electrical connector. Besides, the terminal is spaced at an elastic space with the bottom side of the tongue portion. In the other word, the height of the bending section of the terminal is higher than the standard specification. Therefore, even if the deviation of the mating terminal is greater, the electrical connection between the terminal and the mating terminal is still fine. The quality of transmitting signal will not be reduced because the poor contact between the terminal and mating terminal as happened during use of the prior art electrical connector.

BRIEF DESCRIPTION OF THE DRAWINGS

Other features and advantages of this invention will become more apparent in the following detailed description of the preferred embodiments of this invention, with reference to, the accompanying drawings, in which.

DETAILED DESCRIPTION OF THE PREFERRED EMBODIMENTS

Figure 1:
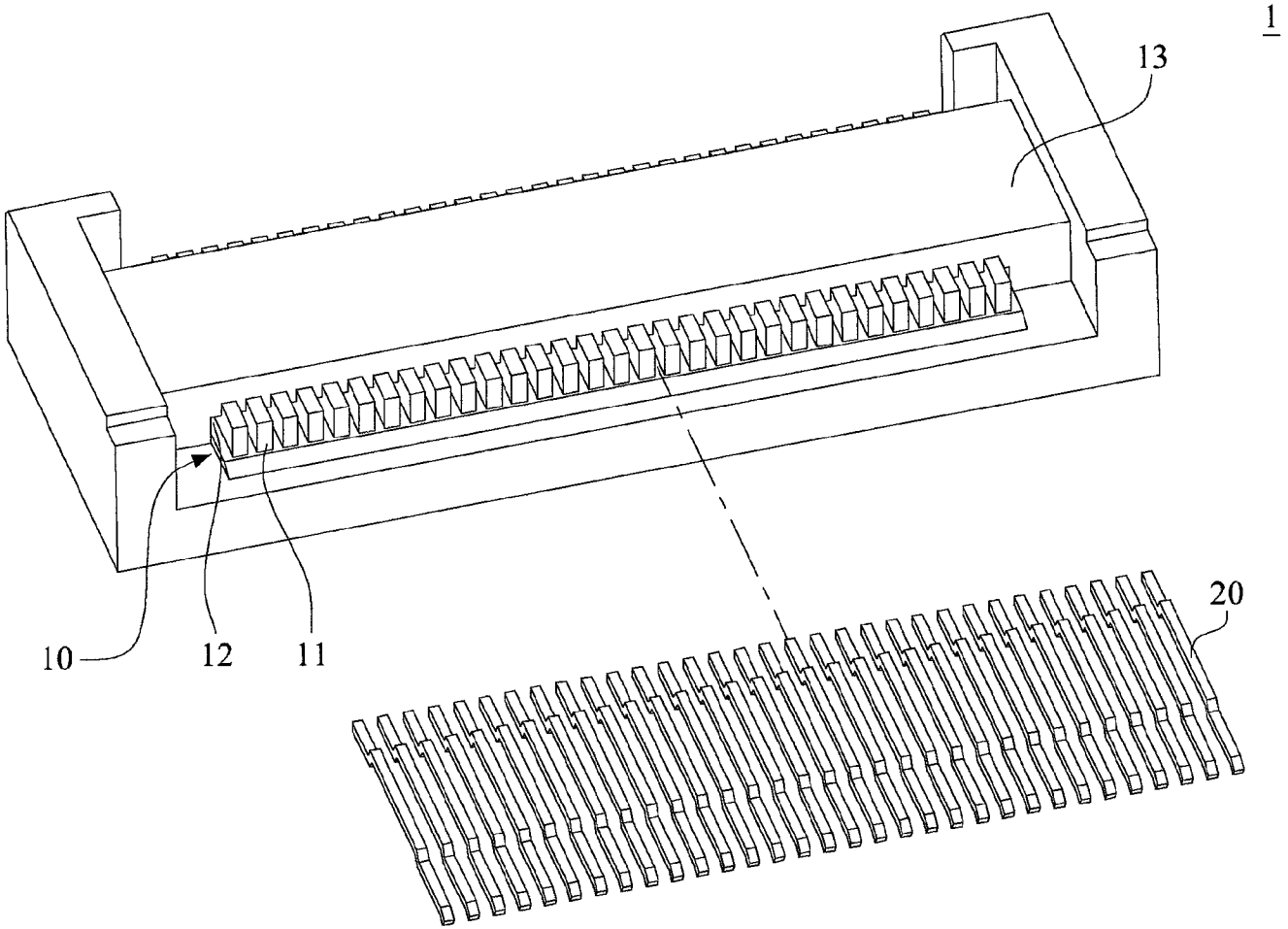
FIG.1(Prior Art)
FIG. 1 is a partially exploded view of an electrical connector of the prior art.
Figure 2:
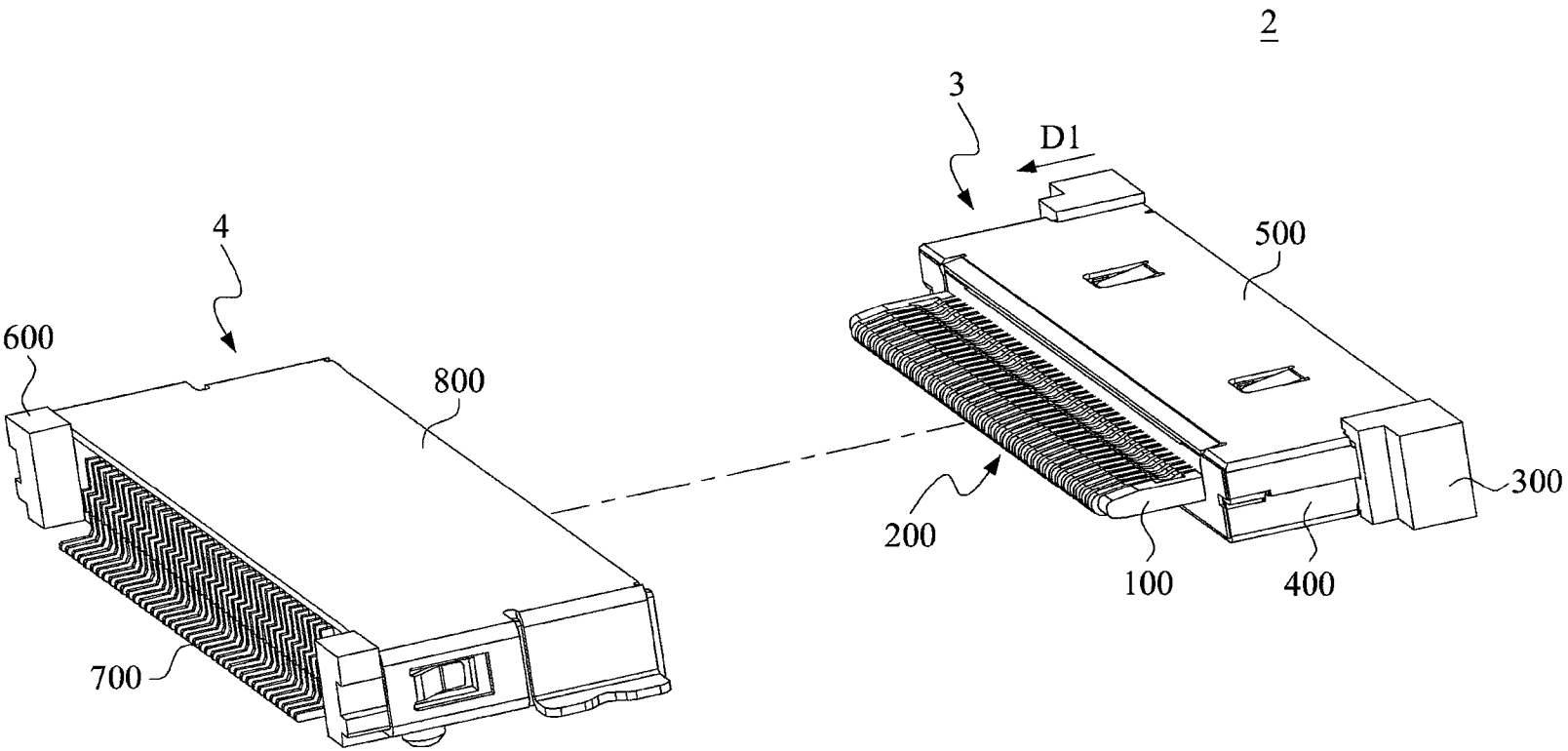
FIG. 2 is a perspective view of a connector assembly of the present invention.

FIG. 2 is a perspective view of a connector assembly of the present invention. As illustrated, the connector assembly 2 includes an electrical connector 3 and a mating electrical connector 4. The electrical connector 3 is inserted and electrically connected to the mating electrical connector 4 along an insertion direction D1.

Figure 3:
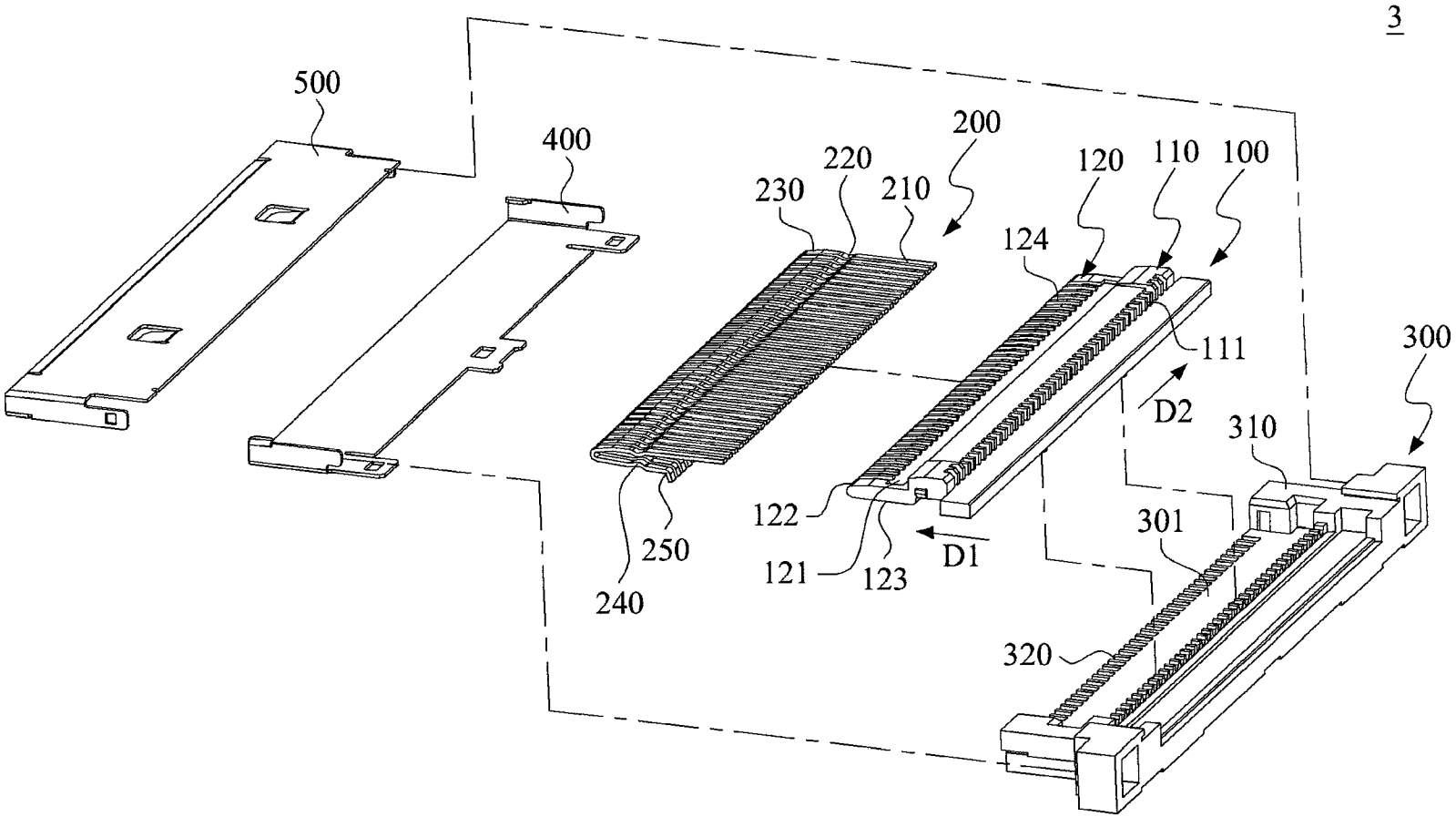
FIG. 3 is a perspective view of an electrical connector of the present invention.
Figure 4:
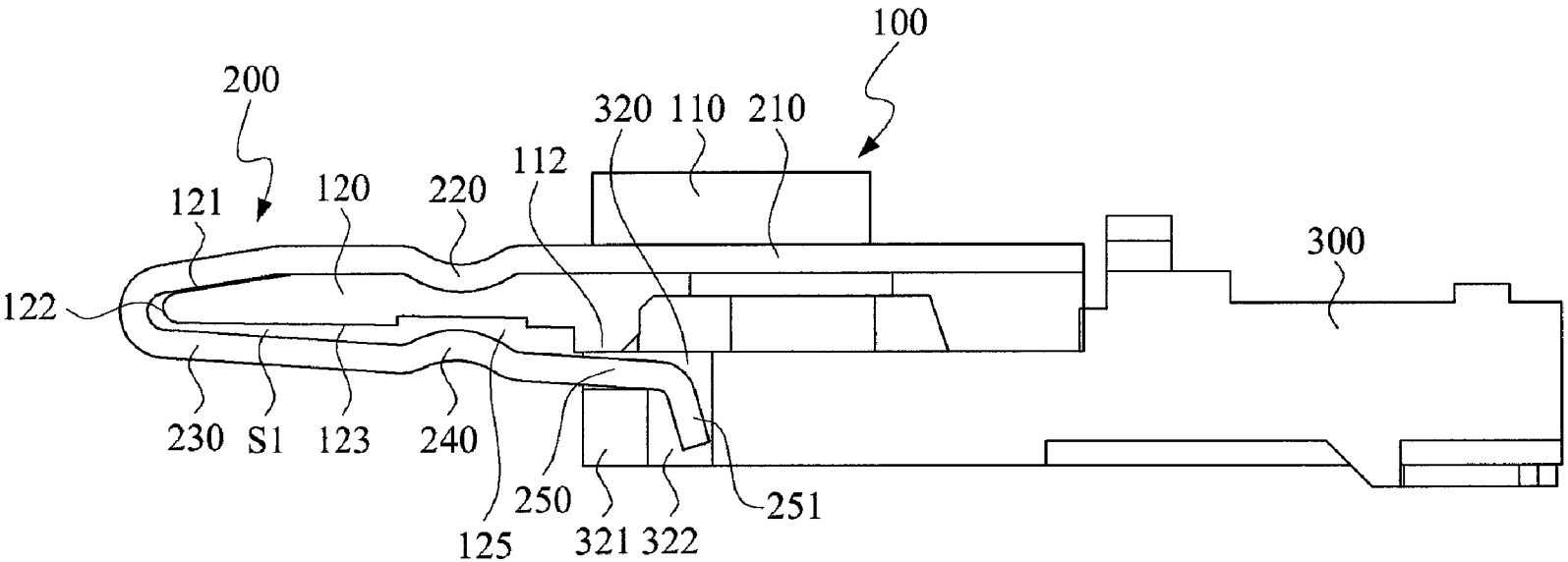
FIG. 4 is a partially cross-sectional view of the electrical connector of the present invention.

FIG. 3 is a perspective view of an electrical connector of the present invention. FIG. 4 is a partially cross-sectional view of the electrical connector of the present invention. The electrical connector 3 accordingly includes a terminal fastening element 100, a plurality of terminals 200, an insulation body 300, a first metal shell 400 and a second metal shell 500. The terminal fastening element 100 is assembled onto the insulation body 300 and includes a terminal fastening portion 110 and a tongue portion 120. The terminal fastening portion 110 is formed with a plurality of terminal through holes 111, which are arranged along an arranging direction D2 and which extend along the insertion direction D1. The terminal fastening portion 110 has a blocking protrusion 112.

The tongue portion 120 extends from the terminal fastening portion 110, and has a top side 121, a bottom side 123 and a front end 122. A plurality of the terminal separators project from the tongue portion 120. In this case, the terminal separators 124 are arranged along the arranging direction D2 and are exposed from the top side 121, front end 122 and the bottom side 123 of the tongue portion 120 along the insertion direction D1. The bottom side 123 of the tongue portion 120 is formed with a groove 125 extending along the arranging direction D2.

The terminal 200 can be a long blending metal structure arranged along the arranging direction D2. The terminals 200 extend along the insertion direction D1. Each of the terminals 200 has a connecting end 210, an embedding portion 220, a bending section 230, a protrusion portion 240 and a retaining end 250 in sequence. The connecting end 210 is between the connecting end 210 and the bending section 230, and the protrusion portion 240 is between the bending section 230 and the retaining end 250.

The connecting end 210 extends along the insertion direction D1, the connecting end 210 is disposed on the top side 121 of the tongue portion 120 and passes through terminal through hole 111 of the terminal fastening portion 110 along the insertion direction D1 so as to be fixed on the terminal fastening portion 110.

The embedding portion 220 can be an arc structure blending and projecting toward to the top side 121 of the tongue portion 120. The embedding portion 220 is embedded and fixed to the top side 121 of the tongue portion 120. A person having ordinary skill in the art can understand how the embedding portion 220 is embedded and is fixed to the top side 121 of the tongue portion 120 via the insert-molding process.

The bending section 230 covers to top side 121, the front end 122, and the bottom side 123 of the tongue portion 120 and is spaced apart from s the front end 122 and the bottom side 123 of with an elastic space S1. The bending section 230 of the terminal 200 can be received and limited within two adjacent terminal separators 124 to prevent the terminal 200 from contacting relative to each other. The protrusion portion 240 can be an arc structure blending and projecting toward the of the tongue portion 120, and is received within the groove 125.

The insulation body 300 includes a plurality of holding structures 310 to latch the side of the terminal fastening element 100 and to assemble the terminal fastening element 100 to the top side 301 of the insulation body 300. A plurality of terminal retaining recesses 320 are formed on the edge of the top side 301 of the insulation body 300 and are arranged along the arranging direction D2. A retaining protrusion 321 extends from the terminal retaining recess 320, and has a blocking groove 322. The blocking groove 322 is communicated spatially with the terminal retaining recess 320.

The retaining end 250 of the terminal 200 is received within the terminal retaining recess 320 and the blocking protrusion 112 is correspondingly to the terminal retaining recess 320 to prevent the retaining end 250 to disengage from the terminal retaining recess 320. The retaining end 250 includes a hook structure 251 hooking to the blocking groove 322 to prevent the retaining end 250 to disengage from the terminal retaining recess 320.

The first metal shell 400 and the second metal shell 500 cooperatively cover the terminal fastening element 100 and the insulation body 300 to provide electromagnetic wave protection.

Figure 5:
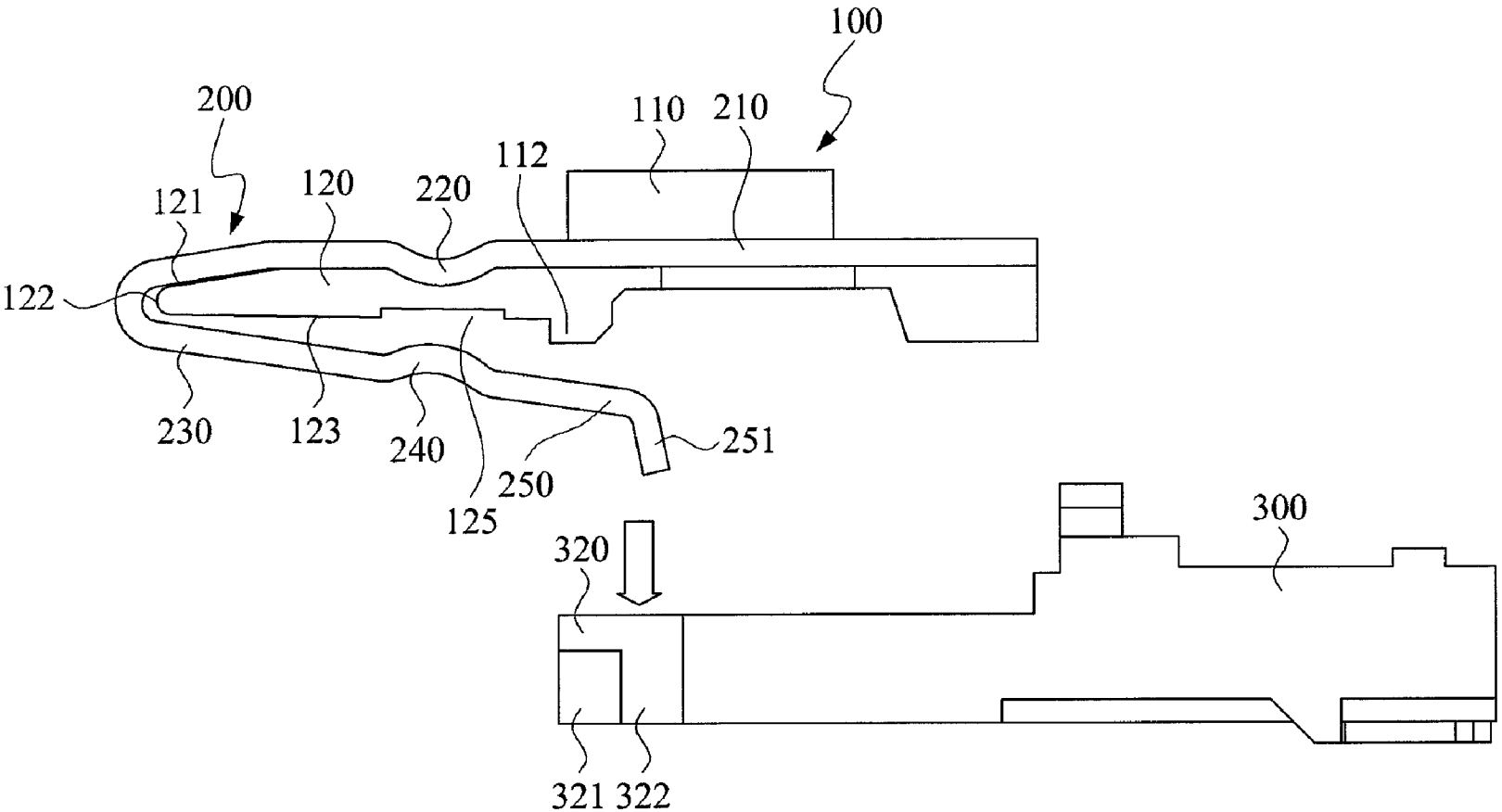
FIG. 5 is a schematic view of the electrical connector of the present invention.

FIG. 5 is a schematic view of the electrical connector of the present invention, wherein the terminal fastening element 100 is not assembled with the insulation body 300. As shown, the terminal 200 is fixed on the terminal fastening element 100 and the included angle of the bending section 230 of the terminal 200 is greater. Therefore, after the terminal fastening element 100 is assembled to the insulation body 300, the retaining end 250 is received within the terminal retaining recess 320 and applies an elastic force onto the retaining protrusion 321 within the terminal retaining recess 320. In this time, the hook structure 251 can be hooked into the blocking groove 322. In conclusion, the blocking protrusion 112 and the retaining protrusion 321 can o prevent the retaining end 250 disengaging from the terminal retaining recess 320.

Figure 6:
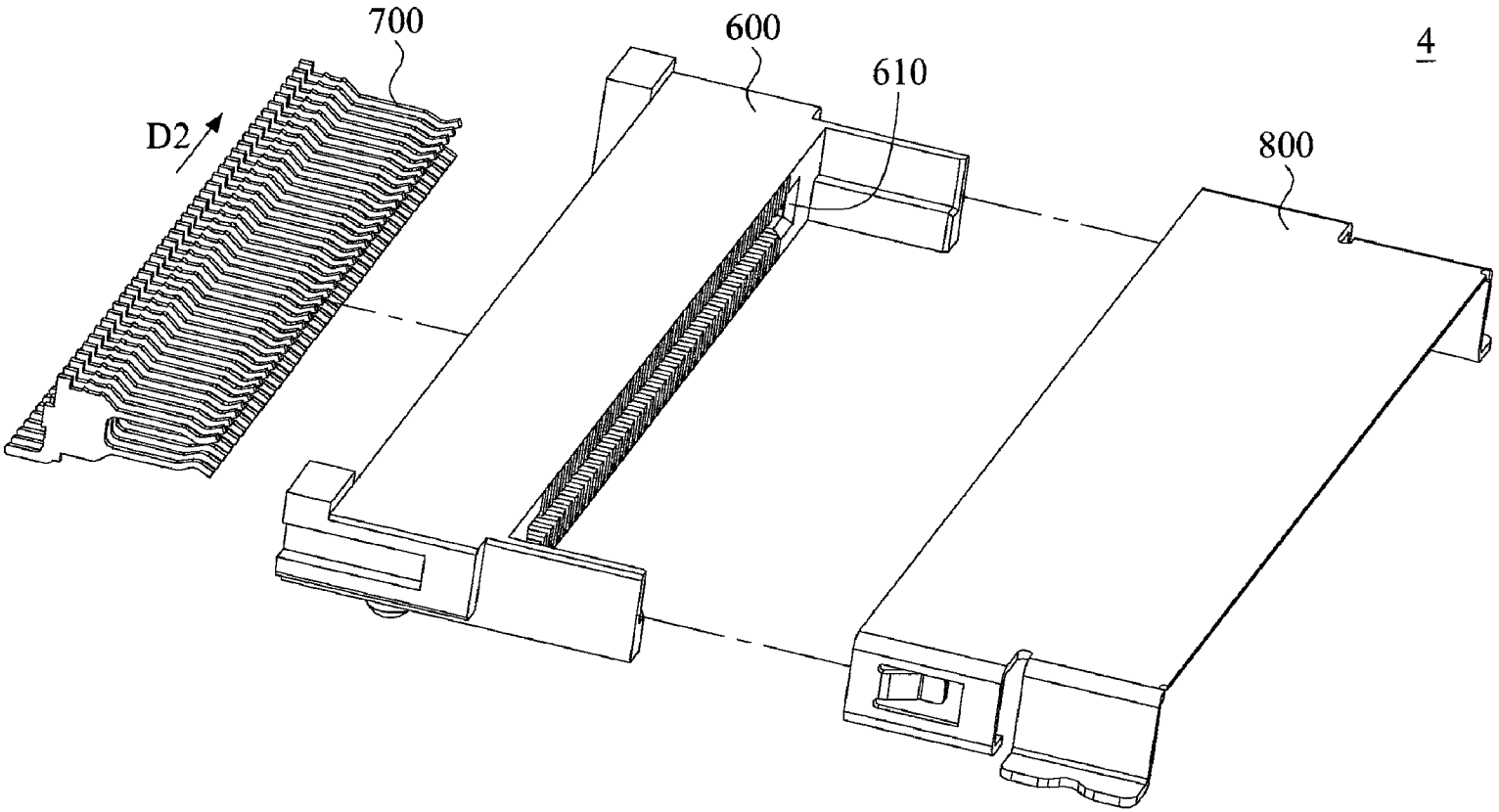
FIG. 6 is an exploded view of a mating electrical connector for inserting into the electrical connector of the present invention.

FIG. 6 is an exploded view of a mating electrical connector for coupling with the electrical connector of the present invention. The mating electrical connector 4 includes a mating insulation body 600, a plurality of mating terminals 700, and a metal shell 800. The mating insulation body 600 has an inserting groove 610 on the front side thereof. The mating terminals 700 are arranged along the arranging direction D2 and can be a U-shape structure. The end of the U-shape structure has two latching portion 710 opposing to each other. The latching portions 710 can be blending structures projecting toward each other. The mating terminals 700 are inserted to the mating insulation body 600 from the back side thereof and are exposed out of the inserting groove 610. The metal shell 800 covers the insulation body 300 to provide electromagnetic wave protection.

Figure 7:
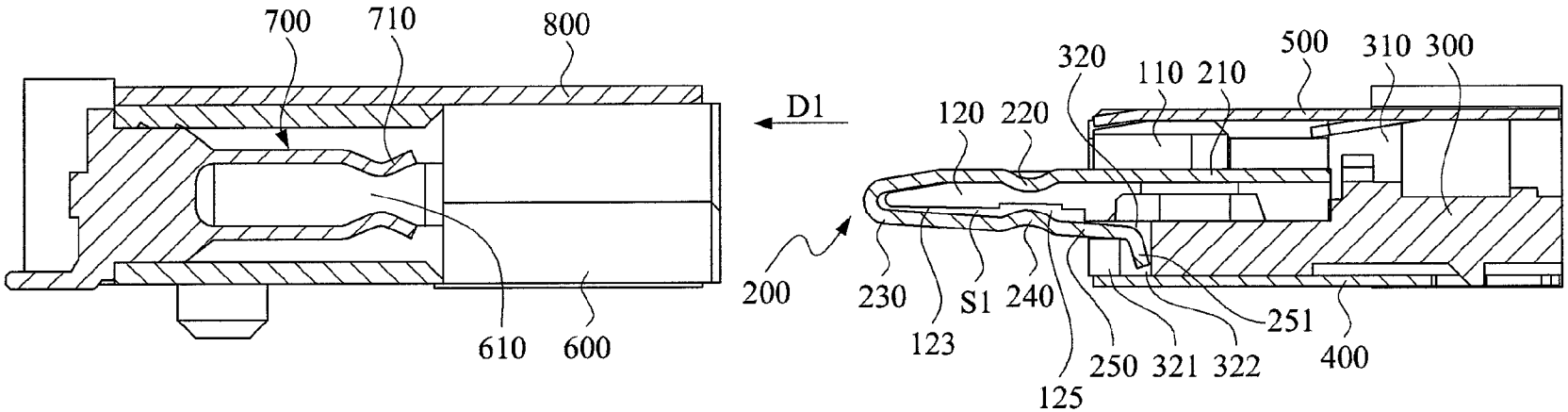
FIG. 7 is a cross-sectional view of a connector assembly of the present invention, wherein the electrical connector and the mating electrical connector are separated from each other.

FIG. 7 is a cross-sectional view of a connector assembly of the present invention, wherein the electrical connector 3 and the mating electrical connector 4 are separated. Under this condition, the bending section 230 is spaced apart from the bottom side 123 of the tongue portion 120 with an elastic space S1.

Figure 8:
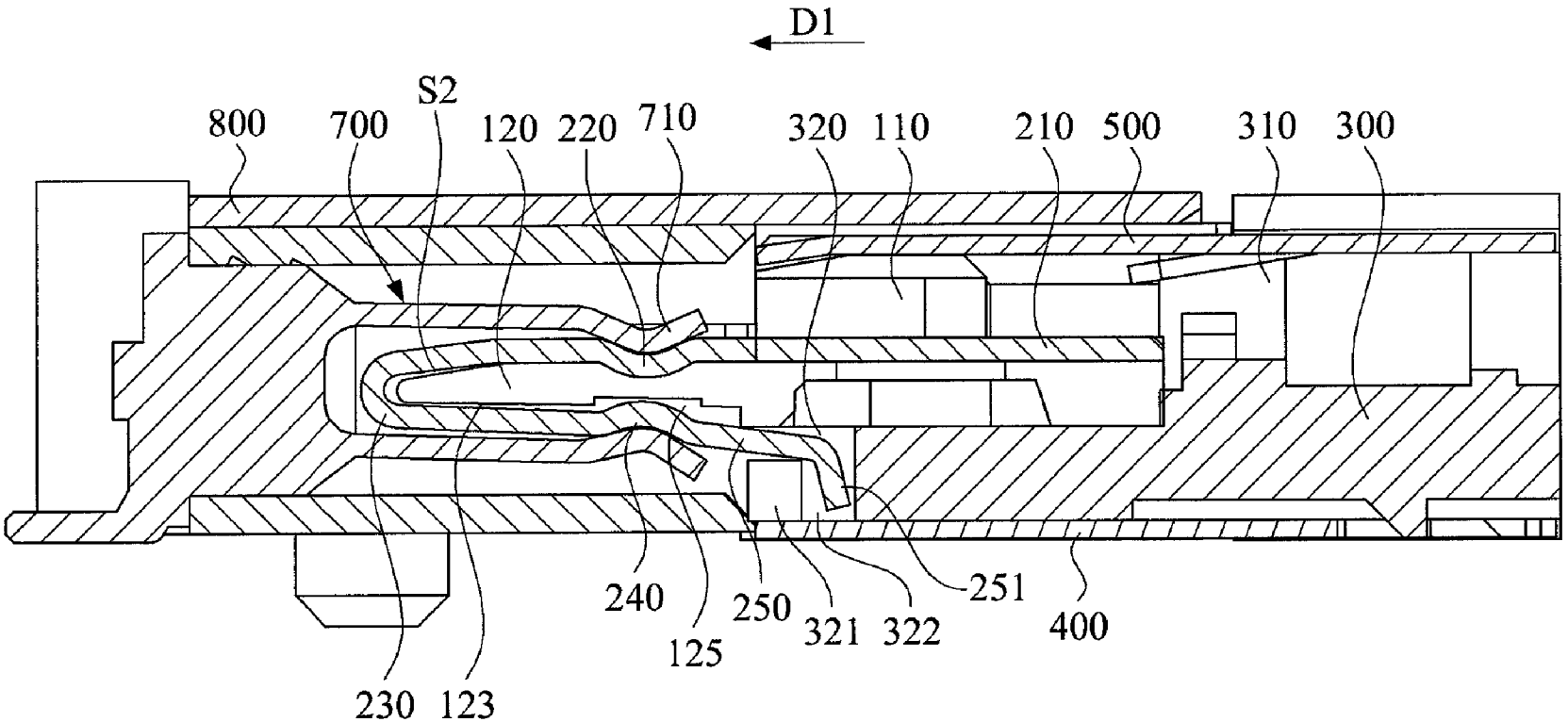
FIG. 8 is a cross-sectional view of a connector assembly of the present invention, wherein the electrical connector is inserted into the mating electrical connector.

As shown FIG. 8, when the electrical connector of the present invention is inserted to the mating electrical connector 4 along the insertion direction D1, the two latching portions 710 of the mating terminal 700 presses the terminal protrusion portion 240 and the embedding portion 220 to decrease the elastic space S1. The bending section 230 bends further to let the included angle of the bending section 230 to become smaller. Therefore, partial of the bending section 230 can contact the bottom side 123 of the tongue portion 120 and/or the protrusion portion 240 can contact the groove. Moreover, the bending section 230 can be raised a little distance to form a sub elastic space S2 between the bending section 230 and the top side 121 of the tongue portion 120. In conclusion, even the distance between the two latching portions 710 is greater, the electrical contact between the terminal 200 and the mating terminal 700 can be fine.

In conclusion, the terminal of the present invention has a bending section covering the top side, the front end and the bottom side of the tongue portion. Therefore, the terminal will not be tilted to disengage e from the terminal groove as encountered during use of prior art electrical connector. Besides, the terminal is spaced apart at an elastic space from the bottom side of the tongue portion. In the other word, the height of the bending section of the terminal is higher than the standard specification. Therefore, even if the deviation of the mating terminal is greater, the electrical connection between the terminal and the mating terminal is still fine. The quality of transmitting signal will not be reduced because the poor contact between the terminal and mating terminal as prior.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electrical connector for inserting into a mating electrical connector, the mating electrical connector including a plurality of mating terminals, the electrical connector comprising:

an insulation body 300 having a terminal retaining recess;

a terminal fastening element 100 assembled to said insulation body, and including a terminal fastening portion, and a tongue portion extending from said terminal fastening portion, and having a top side, a bottom side and a front end; and a plurality of terminals arranged along an arranging direction, each of the terminals defining a connecting end fixed on the terminal fastening portion, a bending section covering to the top side, the front end and the bottom side of the tongue portion and distancing the bottom side of the tongue portion with an elastic space and a retaining end in sequence, the connecting end being fixed on the terminal fastening portion, the bending section covering to the top side, the front end and the bottom side of the tongue portion and distancing the bottom side of the tongue portion with an elastic space, the retaining end being received and applying an elastic force onto a terminal retaining recess;

wherein, when the electrical connector is inserted into the mating electrical connector, the mating terminal pushes the terminal to decrease the elastic space.

2. The electrical connector according to claim 1, wherein the terminal further defines an embedding portion between the connecting end and the bending section, the embedding portion being embedded and fixed into the top side of the tongue portion.

3. The electrical connector according to claim 1, wherein when the electrical connector is inserted into the mating electrical connector, the mating terminal pushing the terminal to decrease the elastic space while the bending section partially contacts the bottom side of the tongue portion.

4. The electrical connector according to claim 1, wherein in case the terminal defines a protrusion portion between the bending section and the retaining end, the protrusion portion extending toward the bottom side of the tongue portion.

5. The electrical connector according to claim 4, wherein the tongue portion has a groove formed in the bottom side of, the protrusion portion being correspondingly to said groove, when the electrical connector is inserted into the mating electrical connector, the mating terminal pushing the terminal to decrease the elastic space while the protrusion portion engages the groove.

6. The electrical connector according to claim 1, wherein the terminal fastening portion includes a plurality of terminal through holes, the terminal through holes being arranged along the arranging direction and extending along an insertion direction, each of the connecting end of the terminals penetrating through a respective one of the terminal through holes, the tongue portion having a plurality of terminal separations arranged along the arranging direction and disposed on the top side, the front end and the bottom side of the tongue portion along the insertion direction, the bending sections being disposed between two of the contiguous terminal separations.

7. The electrical connector according to claim 1, wherein the terminal fastening portion has a blocking protrusion, the blocking protrusion being correspondingly to the terminal retaining recess to prevent the retaining end out of the terminal retaining recess.

8. The electrical connector according to claim 7, wherein the retaining end includes a hook structure, the insulation body having a blocking groove, the blocking groove and the terminal retaining recess being in spatial communication with each other, the hook structure being hooked within the blocking groove to prevent the retaining end out of the terminal retaining recess.

9. The electrical connector according to claim 1, wherein the insulation body includes a plurality of the holding structures, the holding structure being installed on side of the terminal fastening element to assemble with the terminal fastening element to the top side of the insulation body.

* * * * *